United States Patent [19]

Sinn

[11] 3,933,352

[45] Jan. 20, 1976

[54] SHEET PILE DELIVERY FOR PRINTING PRESSES

[75] Inventor: Helmut Sinn, Wiesloch, Baiertal, Germany

[73] Assignee: Roland Offsetmaschinenfabrik Faber & Schleicher AG, Germany

[22] Filed: Dec. 11, 1974

[21] Appl. No.: 531,811

[52] U.S. Cl. ..... 271/189; 271/204; 271/221

[51] Int. Cl.[2] ..... B65H 29/34; B65H 29/04

[58] Field of Search ..... 271/204, 221, 222, 189, 271/192, 205, 206, 218; 214/60 K, 65

[56] References Cited

UNITED STATES PATENTS

| | | | |
|---|---|---|---|
| 584,633 | 6/1897 | Gottlieb | 271/221 |
| 2,113,650 | 4/1938 | Golber | 271/189 |
| 2,273,689 | 2/1942 | Boron et al. | 271/192 |
| 2,950,108 | 8/1960 | Golding | 271/189 |

*Primary Examiner*—John J. Love
*Assistant Examiner*—Bruce H. Stoner, Jr.
*Attorney, Agent, or Firm*—Wolfe, Hubbard, Leydig, Voit & Osann, Ltd.

[57] ABSTRACT

A sheet delivery arrangement including a conveyor for depositing sheets on a pile and a jogger for squaring up the pile, the jogger having an associated interceptor member spaced slightly above the pile for intercepting the curled edge of a sheet deposited on the pile to prevent such curled edge from being inserted between the jogging element and the pile. The interceptor member is coupled to the conveyor for movement between an interposed position phased with the arrival of a sheet and a retracted position clear of the pile in which the engaged edge of the sheet becomes fully supported on the pile. In the preferred embodiment the interceptor member is mounted upon the jogging element for movement with the latter, and in an alternate embodiment the interceptor member is independently mounted for movement synchronized with the arrival of successive sheets.

6 Claims, 11 Drawing Figures fig.2.
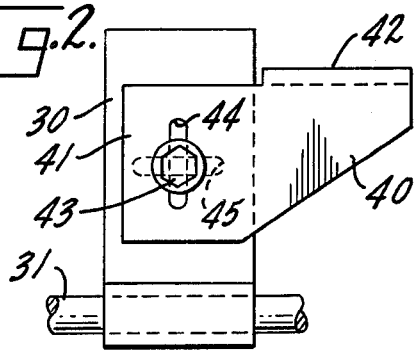
fig.3a.
(PRIOR ART)
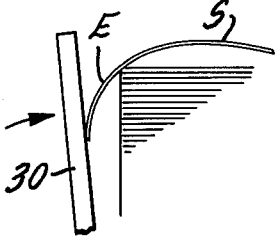
fig.3b.
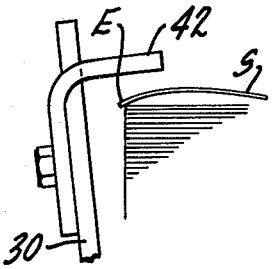
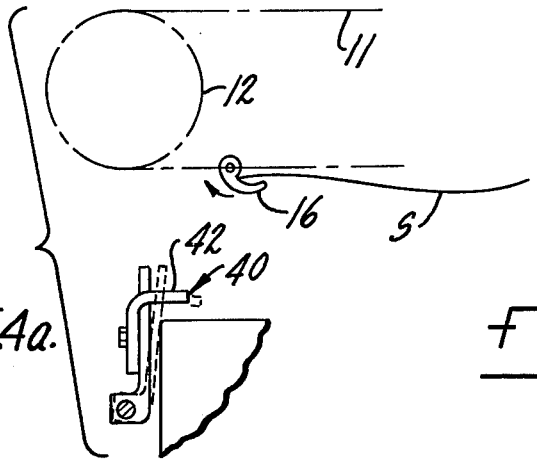
fig.4a.
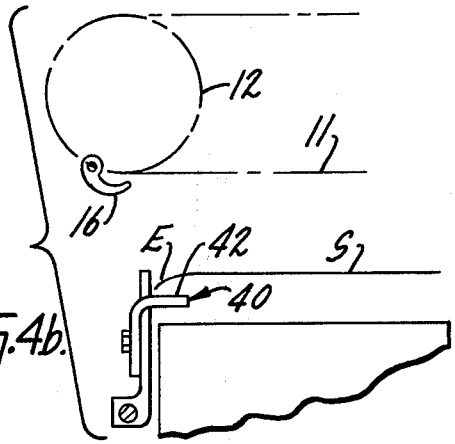
fig.4b.
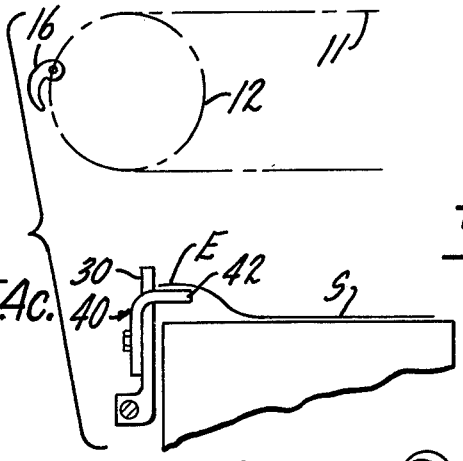
fig.4c.
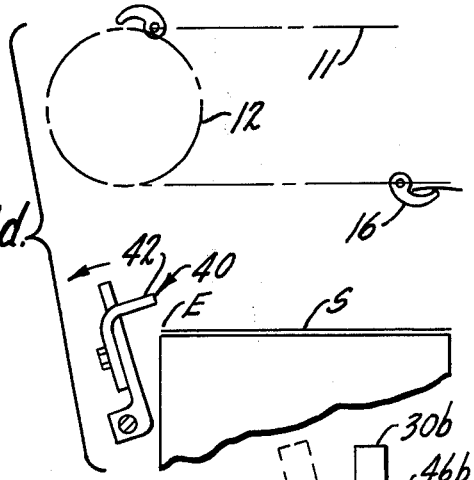
fig.4d.
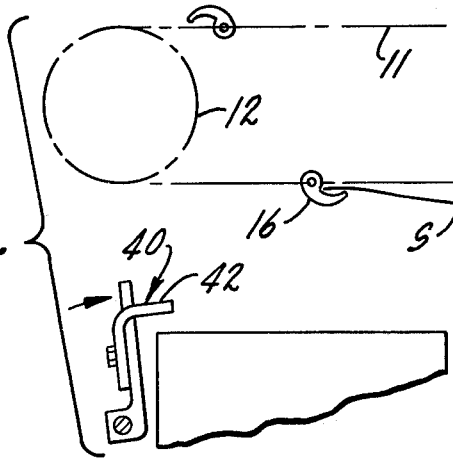
fig.4e.
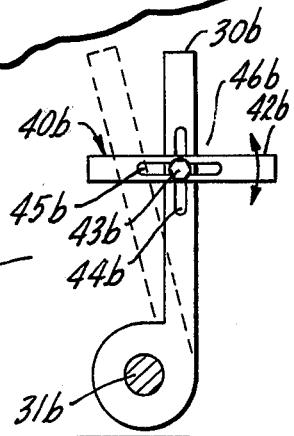
fig.6.

SHEET PILE DELIVERY FOR PRINTING PRESSES

In a conventional sheet pile delivery forming a part of a sheet-fed lithograph press the printed sheets are transported by grippers on a conveyor. Successive grippers are released at a predetermined phase position so that the sheets are deposited one by one on a pile formed on a platform below the conveyor. To keep the pile square and orderly the topmost portion of the pile is acted upon along one or more of its edges by jogging elements. Such jogging elements are normally power oscillated for the purpose of engaging the projecting edge of an errant sheet and gently moving it into alinement with the pile.

Such devices work well in the case of sheets which are relatively thick and perfectly flat. Often, however, the edge of a sheet may be downwardly curled due to the amount, and pattern, of damp ink in the printed impression; however, curling may also occur in thin sheet stock quite independently of the inking.

Because of the curl, the edge of the sheet tends to hang downwardly, over the edge of the pile, into a position interposed between the jogging element and the pile. Consequently, the jogging element cannot apply an edgewise push to the sheet to restore it to proper position on the pile, but, instead, the jogging element acts flatly upon the surface of the sheet, creasing the downwardly bent portion over the edge of the pile. The situation is complicated by the fact that a curled sheet does not settle from the point of release onto the pile in a consistent or predictable way; a curled leading edge may tend, for example, to overtravel in an irregular fashion depending upon the amount of curl. It is possible for an offending sheet to be jogged by hand or promptly removed by an alert and dexterous pressman, but more frequently an entire succession of curled sheets may be trapped between the jogging element and the pile requiring shut-down of the press to correct the situation.

It is, accordingly, an object of the present invention to provide means for intentionally intercepting the edge of a sheet arriving at the pile to hold the edge in a slightly elevated position until the sheet has come to rest upon the pile so that the curved edge cannot bend around the side of the pile or hang down into the space between the pile and the jogger. It is a related object to provide auxiliary means for supporting the curled edge of a sheet to keep it in a horizontal position thereby to insure that the jogger acts edgewise upon the sheet in performing its jogging function, even in the case of sheets having a serious degree of curl. It is a general object to provide a sheet delivery arrangement which insures the formation of a square and orderly pile independently of the inking pattern on the sheet and which is effective for all thicknesses of sheet stock, even the thinnest sheets which can be normally handled by a lithograph press.

Other objects and advantages of the invention will become apparent upon reading the attached description and upon reference to the drawings in which:

FIG. 2 is a fragmentary elevation looking along the line 2—2 in FIG. 1;

Figure 1:
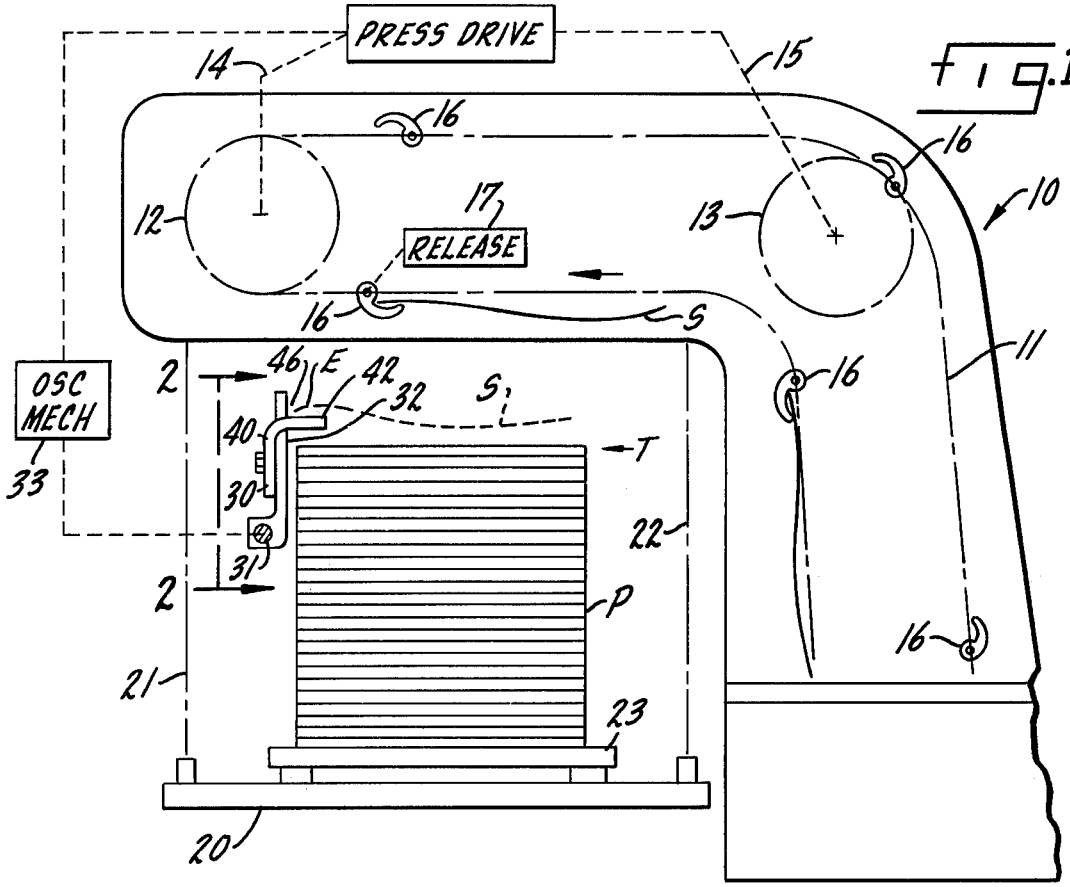
FIG. 1 is an elevational view of a sheet delivery mechanism including a conveyor with pile delivery and set forth in schematic form.
Figure 5:
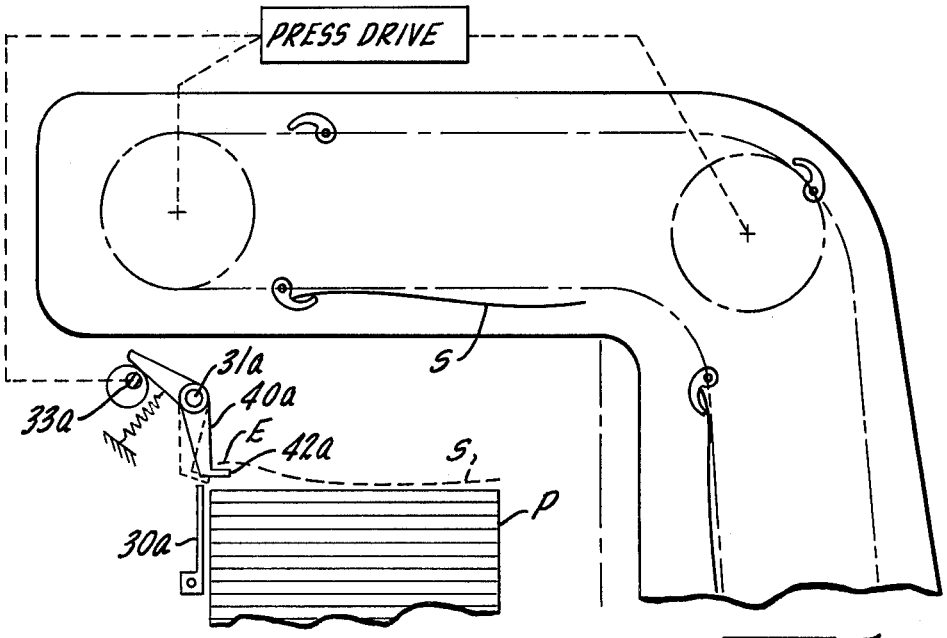

FIG. 3*a* is a diagram showing the curled edge of a sheet hanging down between the jogger and the pile;

FIG. 3*b* is a corresponding diagram showing how the edge of a curled sheet is in position to be acted upon edgewise by the jogger in the inventive construction;

FIGS. 4*a*–4*e* inclusive are a set of stop motion diagrams showing the manner in which the interceptor member performs its function synchronized with the arrival of a curled sheet; and FIG. 5 is a view similar to FIG. 1 but showing an alternate.

FIG. 6 shows a further alternate construction.

Turning now to the drawings, there is shown a delivery mechanism 10 for receiving printed sheets from an associated lithograph press and for depositing such sheets upon a pile for periodic removal. The sheets are transported by a pair of endless conveyor chains diagrammatically indicated at 11 and which chains are trained about pairs of sprocket wheels 12, 13, the drive connection between the conveyor and the press drive being indicated by the dotted lines 14, 15. At spaced positions along the conveyor chains 11 are sets of grippers 16. A conventional release mechanism 17 is provided for releasing the successive sheets at a predetermined position, a typical sheet, at point of release, being indicated, by the solid line, at S.

Arranged below the point of release is a delivery platform 20 supported upon chains 21, 22 and which carries a pallet 23 upon which the pile of sheets, indicated at P, is deposited. It will be understood that the platform supporting means is entirely conventional and of the type in which the platform 20 is automatically and progressively lowered so that the top of the pile, indicated at T, is maintained at a predetermined position with respect to the level at which the sheets are released.

In accordance with the present invention a jogging element is provided for engaging at least one edge of the pile for squaring up the pile, the jogging element having an associated interceptor member which is spaced slightly above the pile and which is movable inwardly and outwardly with respect to the pile for providing temporary support for the adjacent curled edge of an arriving sheet to prevent such edge from being inserted between the jogging element and the pile, with the interceptor member being cyclically retracted clear of the pile so that the engaged edge may become fully supported upon the pile in position for edgewise engagement by the jogging element.

Thus referring to FIGS. 1 and 2 there is provided a jogging element 30 mounted upon a horizontal shaft 31 and having a flat face 32 which extends vertically along the pile to a point slightly above the top of the pile. For the purpose of oscillating the shaft 31, an oscillating mechanism, generally indicated at 33, is connected between the shaft and the press drive. Since such oscillating mechanism is per se conventional, it is not illustrated in detail. For intercepting the curled edge E of an arriving sheet S, which is shown dotted in FIG. 1 in the act of arrival, an interceptor member 40 is provided which is secured to the jogging element 30 and which has a base portion 41 and a horizontal ledge portion 42 which, in the receiving position illustrated in FIG. 1, projects slightly over the edge of the pile. Preferably the base of the interceptor member is secured to the jogging element by means providing relative adjustment. For example, the interceptor member may be clamped to the jogging element by means of a clamping screw 43 with the members being provided with slots 44, 45 for relative vertical and horizontal adjustment.

Preferably the height of the ledge 42 is so adjusted that it reliably clears the top of the pile on the inward stroke while being spaced a small amount downwardly from the upper end of the jogging element to form a reliably deep, right-angled pocket 46.

The benefit provided by the interceptor member 40 will be apparent by comparing FIGS. 3*a* and 3*b*. FIG. 3*a* shows how, in the absence of the present invention, the curled edge E of a delivered sheet may become inserted between the jogging element and the pile so that the hanging portion, instead of being pushed into precise alinement with the pile in the ensuing stroke of the jogging element, is, instead, flattened alongside the pile. This is to be contrasted with the present construction, FIG. 3*b*, which insures that the curled edge E will, upon retraction of the interceptor member, be supported with the edge either alined with the edge of the pile or projecting only a small amount therefrom so that any engagement by the jogging element takes place edgewise, just as though the sheet were perfectly flat and free of any curling tendency.

It is necessary in practicing the present invention for the oscillating mechanism 33 to produce one cycle of oscillation of the jogging element, and the interceptor member which it supports, for each sheet arrival and for the movement to be synchronized so that the interceptor member is in a position to receive a sheet as it arrives at the top of the pile, with subsequent retraction, as soon as the sheet has settled upon the pile, to release the supported edge to free the interceptor for reinsertion in readiness for the next sheet in the series.

Such phasing will be made clear upon reference to the series of stop motion views 4*a*–4*e*. In FIG. 4*a* the sheet S is in the act of being released. At this time the interceptor member 40 is either in readiness to receive the sheet or completing jogging movement prior to assuming a position of readiness. In any event the interceptor member is in receiving position as the sheet settles downwardly toward the pile, as illustrated at 4*b*.

Next, referring to FIG. 4*c*, the curled edge E of the sheet is engaged and supported by the interceptor member 40 while the body of the sheet is supported by the pile. A moment thereafter, after the sheet has settled upon the pile, the interceptor member 40 is retracted as shown in FIG. 4*d*. Such retraction does not disturb the lateral positioning of the sheet because of the large amount of friction between the body of the sheet and the top of the pile. As the interceptor member is withdrawn, the edge E of the sheet drops to become fully supported by the pile. Following this, and as a new sheet S approaches on the conveyor, the interceptor member 40 rocks forwardly to intercept the new sheet (FIG. 4*e*) and with slight forward overtravel of the jogging element 30 (illustrated in FIG. 4*a*) so that the latter may engage the edge of the deposited sheet to perform its normal jogging function.

It will be apparent to one skilled in the art that the structure may, if desired, be simplified by permanently securing the interceptor member 40 to the jogging element 30. If desired the jogging element may be slit and a portion bent, as a tongue projection, into horizontal sheet-intercepting position. As a further alternative the interceptor member may be in the form of a simple stud or bracket projection permanently secured to, and extending horizontally from, the face of the jogging element in the same relative position as illustrated in FIG. 1.

Further in accordance with the present invention it is not essential for the interceptor member 40 to be supported upon, or to form a part of, the jogging element. Thus it will be seen upon referring to FIG. 5 that the interceptor member may be separately mounted and separately oscillated between its intercepting and retracted positions. In this figure corresponding elements are indicated by corresponding reference numerals with addition of subscript *a*. In this embodiment the interceptor member, indicated at 40*a* is in the form of a dog-leg lever rockable about a shaft 31*a* and having a receiving ledge 42*a*. For moving the interceptor member from its illustrated receiving position to a retracted position (indicated by the dot-dash outline, an oscillating mechanism is provided in the form of a cam 33*a* having a connection to the press drive and which rotates on a 1:1 basis with respect to the deposited sheets. The cam 33*a* is so phased that the ledge 42*a* is safely interposed in the path of a curled edge E as the sheet S settles down into contact with the pile. The associated jogging element, indicated at 30*a*, may be driven in the same fashion as the jogging element in FIG. 1 or, if desired, the jogging element may be of the stationary type closely spaced to the pile and thus serving as a limit stop to determine the registered positions of the added sheets. The effect of the inventive construction is the same as in FIG. 1, that is, the curled edge of a deposited sheet is positively prevented from hanging down between the jogger and the pile.

While only one interceptor member 40 (or 40*a*) has been illustrated mounted on and actuated by a shaft 31 (or 31*a*), it will be apparent that two or more such interceptors may be spaced along the shaft for engaging the curled edge at more than one point. More specifically, two of the assemblies 30, 40 may be provided in spaced relation on shaft 31 and cooperating to engage the edge of a single sheet. Also additional interceptor assemblies, similarly phased, may be provided along more than one edge of the piles. The term "oscillating" is used herein in the general sense of cyclical back and forth movement.

In accordance with one of the aspects of the invention means are provided for clamping the interceptor member to the jogging element in such a way as to permit not only rectangular adjustment but also angular adjustment. Thus referring to FIG. 6 a modified jogging element 30*b* is shown oscillated by shaft 31*b* and mounting an interceptor member 40*b*. The members are provided with slots 44*b*, 45*b* engaged by a clamping screw 43*b*. In this way not only the elevation and degree of projection may be changed but the interceptor member may be rocked in the direction of the arrow prior to being clamped in fixed position; for example, it might be desirable in some circumstances for the interceptor member to be rocked downwardly, making the substantially right angles pocket 46*b* slightly obtuse. Thus the term "generally right angled" as applied to the pocket is intended to include angles ranging from a right angle to somewhat greater than a right angle.

What I claim is:

1. In a sheet delivery arrangement for a sheet-fed lithograph press, the combination comprising a driven sheet conveyor having grippers at spaced intervals, a platform under the conveyor, means acting upon the grippers in a predetermined phase position for dropping sheets seriatim toward the platform to form a pile thereon, means including a vertically extending jogging element extending along at least one side of the pile adjacent the top thereof and movable away from the pile and then adjacent the pile to square up the edge thereof, the jogging element having a horizontal interceptor member in the form of a projection extending in the direction of the pile so as to overlie the pile, the projection being of such limited extent as to clear the lateral edge of the pile when the jogging element is in fully retracted position, and means for oscillating the jogging element in phase synchronism with the movement of the conveyor into its sheet dropping position so that the projection receptively extends over the pile to intercept the edge of a sheet dropped from the conveyor thereby to prevent the edge of the sheet, particularly when in curled condition, from becoming inserted between the jogging element and the pile, the jogging element being subsequently retracted clear of the pile in the course of its oscillating movement permitting the intercepted edge of the sheet to become fully supported upon the pile and freeing the projection to receive the next sheet.

2. The combination as claimed in claim 1 in which means are provided for adjustably clamping the interceptor member to the jogging element.

3. The combination as claimed in claim 1 in which the interceptor member is in the form of a projection extending generally at right angles to the jogging element spaced a small amount downwardly from the upper end of the jogging element to form an angular pocket for receiving the edge of an arriving sheet.

4. The combination as claimed in claim 1 in which a supporting shaft extends horizontally alongside the pile, at least one recited jogging element with an associated interceptor member being mounted on the shaft, and means coupled to the press drive for oscillating the shaft.

5. The combination as claimed in claim 1 in which the interceptor is in the form of a projection spaced a small amount downwardly from the upper end of the jogging element and having clamping means permitting relative angular adjustment of the projection prior to clamping of the projection in position.

6. In a sheet delivery arrangement for a sheet-fed lithograph press, the combination comprising a driven sheet conveyor having grippers at spaced intervals, a platform under the conveyor, releasing means acting upon the grippers in predetermined phase position for dropping sheets seriatim toward the platform to form a pile thereon, means including a vertically extending jogging element at the top of the pile and extending along at least one side thereof, means for oscillating the jogging element for cyclical engagement of the edge of successively dropped sheets to square up the pile, an interceptor member associated with the jogging element and projecting horizontally inward above the pile, the interceptor member being made up of a horizontal ledge portion and a vertical portion rigidly joined together in intersecting relation to form a deep, positive generally right-angled pocket for the leading edge of the sheet, means mounting the interceptor member for horizontal movement between a sheet intercepting position and a retracted position in which it is clear of the pile, and a cyclical drive connection between the conveyor and the interceptor member so phased that the interceptor member is in its intercepting position as a sheet from the conveyor arrives at the pile, the leading edge of the sheet being thereby engaged and temporarily supported in the pocket of the interceptor member in registered relation above the level of the pile while the body of the sheet settles on pile so that the leading edge cannot, by reason of curling, become inserted between the jogging element and the pile, the interceptor member being subsequently retracted during the course of its cyclical movement with the body of the sheet being held by friction against the pile so that the engaged edge of the sheet may become fully supported upon the pile for edgewise engagement by the jogging element.

* * * * *